US009957723B1

(12) United States Patent
Collison

(10) Patent No.: US 9,957,723 B1
(45) Date of Patent: May 1, 2018

(54) MORTARLESS STONE VENEER

(71) Applicant: Ryan W. Collison, Norfolk, NE (US)

(72) Inventor: Ryan W. Collison, Norfolk, NE (US)

( * ) Notice: Subject to any disclaimer, the term of this patent is extended or adjusted under 35 U.S.C. 154(b) by 0 days. days.

(21) Appl. No.: 15/719,954

(22) Filed: Sep. 29, 2017

(51) Int. Cl.
*E04F 13/07* (2006.01)
*E04F 13/14* (2006.01)
*E04F 13/08* (2006.01)

(52) U.S. Cl.
CPC ..... *E04F 13/147* (2013.01); *E04F 13/07* (2013.01); *E04F 13/0835* (2013.01); *E04F 13/0839* (2013.01)

(58) Field of Classification Search
CPC ..... E04F 13/147; E04F 13/07; E04F 13/0835; E04F 13/0839
See application file for complete search history.

(56) References Cited

U.S. PATENT DOCUMENTS 8,387,323 B2 * 3/2013 Mickelson ..... B28B 7/007 52/314
9,079,380 B2 * 7/2015 Monteer ..... B32B 21/02
9,169,652 B2 * 10/2015 Steffes ..... E04F 13/0873
9,249,579 B2 2/2016 Dickey et al.
9,677,283 B2 * 6/2017 Attebery, II ..... E04F 13/007
9,803,371 B2 * 10/2017 Attebery, II ..... E04F 13/0835
2007/0130860 A1 * 6/2007 Paquette ..... E04F 13/0835 52/311.1
2011/0175255 A1 * 7/2011 Wernette ..... B28B 7/007 264/271.1
2011/0289877 A1 * 12/2011 Correia ..... E04F 13/0851 52/309.4

* cited by examiner

*Primary Examiner* — Andrew J Triggs
(74) *Attorney, Agent, or Firm* — Dennis L. Thomte; Thomte Patent Law Office LLC

(57) ABSTRACT

A mortarless stone veneer is provided which is in a panel format and which has an upper end, a lower end, a first end, a second end, a front side and a rear side. An upper attachment flange has its lower end embedded in the rear side of the panel so as to extend upwardly therefrom. A first end attachment flange has its inner end embedded in the panel at the first end thereof. A second end attachment flange has its inner end embedded in the panel at the second end. The end attachment flanges are bendably movable between an extended attachment position and a folded position behind the panel.

11 Claims, 4 Drawing Sheets

MORTARLESS STONE VENEER

BACKGROUND OF THE INVENTION

Field of the Invention

This invention relates to a mortarless stone veneer and more particularly to a mortarless stone veneer which is comprised of a concrete panel having an upper attachment flange, a first end attachment flange and a second end attachment flange.

Description of the Related Art

The Assignee of this invention has been marketing a mortarless stone veneer for some time wherein the product included a panel which had an attachment flange extending upwardly from the upper end of the panel. Although Assignee's prior product has met with success, Assignee has discovered that there are times when end attachment flanges will stabilize the panel when mounted on a vertically disposed support such as a wall or the like. Further, in Assignee's prior product, there was little thereon to permit some air flow between the panel and the supporting wall to reduce moisture buildup on the wall.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A mortarless stone veneer is disclosed which includes a concrete panel having an upper end, a lower end, a first end, a second end, a front side and a rear side. A rectangular upper attachment flange has its lower end embedded in the rear side of the panel at the upper end thereof so as to extend upwardly from the upper end of the panel. The upper attachment flange is configured to be secured to a vertically disposed support such as a wall. A first end attachment flange has its inner end embedded in the rear side of the panel at the first end of the panel between the upper and lower ends of the panel. The first end attachment flange is selectively bendable with respect to the panel between an outwardly extending attachment position and a folded non-attachment position.

The first end attachment flange extends outwardly from the first end of the panel when in its attachment position to enable the first end attachment flange to be secured to a vertically disposed support such as a wall. The first end attachment flange may be folded inwardly so as to be positioned adjacent the rear side of the panel when in its non-attachment position. A second end attachment flange has its inner end embedded in the rear side of the panel at the second end of the panel between the upper and lower ends thereof. The second end attachment flange is selectively bendable with respect to the panel between an outwardly extending attachment position and a folded non-attachment position. The second end attachment flange extends outwardly from the second end of the panel when in its attachment position to enable the second end attachment flange to be secured to a vertically disposed support such as a wall. The second end attachment flange may be positioned adjacent the rear side of the panel at the second end of the panel when in its folded non-attachment position.

In the preferred embodiment, each of the first and second end attachment flanges are flat and generally rectangular. In the preferred embodiment, the attachment flanges may have pre-drilled nail or screw openings formed therein. In the preferred embodiment, the first and second end attachment flanges are comprised of either aluminum, steel, plastic or any other material which can withstand the elements. In the preferred embodiment, the panel is comprised of a lightweight concrete.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 1 is a perspective view of the mortarless stone veneer panel of this invention mounted on a wall or the like;

DESCRIPTION OF THE PREFERRED EMBODIMENT

Figure 1:
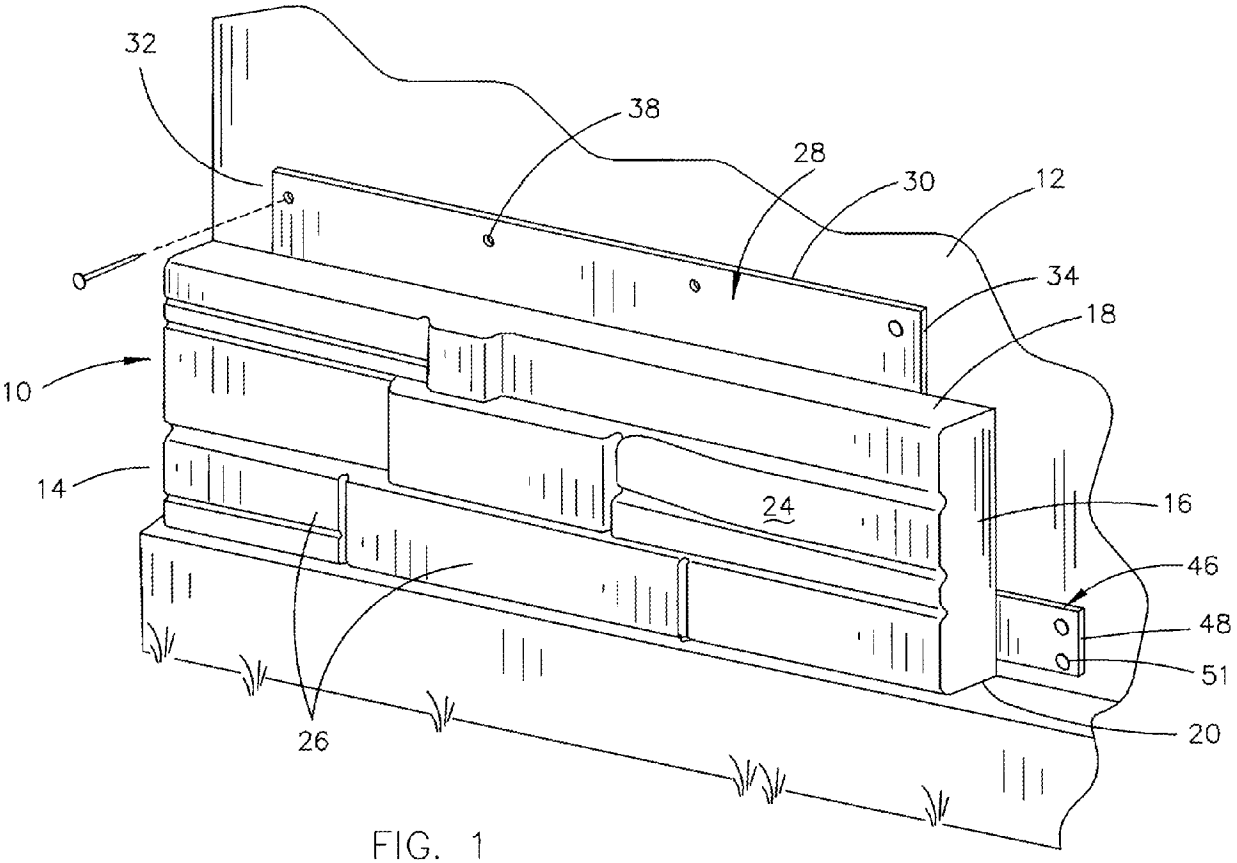

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The mortarless stone veneer of this invention is designated by the reference numeral 10 and is shown in a panel format. For purposes of concise description, the mortarless stone veneer 10 will be described as panel 10. Panel 10 is comprised of concrete or lightweight concrete. Panel 10 may be used on the exterior of a building 12 or on a wall in the interior of a building.

Panel 10 will be described as having a first end 14, a second end 16, an upper end 18, a lower end 20, an inner side 22 and an outer side or face 24. Panel 10 is cast so as to have a plurality of random stones 26 separated by concrete which looks like mortar between the stones, etc. The look of panel 10 can be of a wide range of individual stones, bricks, textures and shapes to multi-stone panels with different stone or brick shapes and textures.

Figure 3:
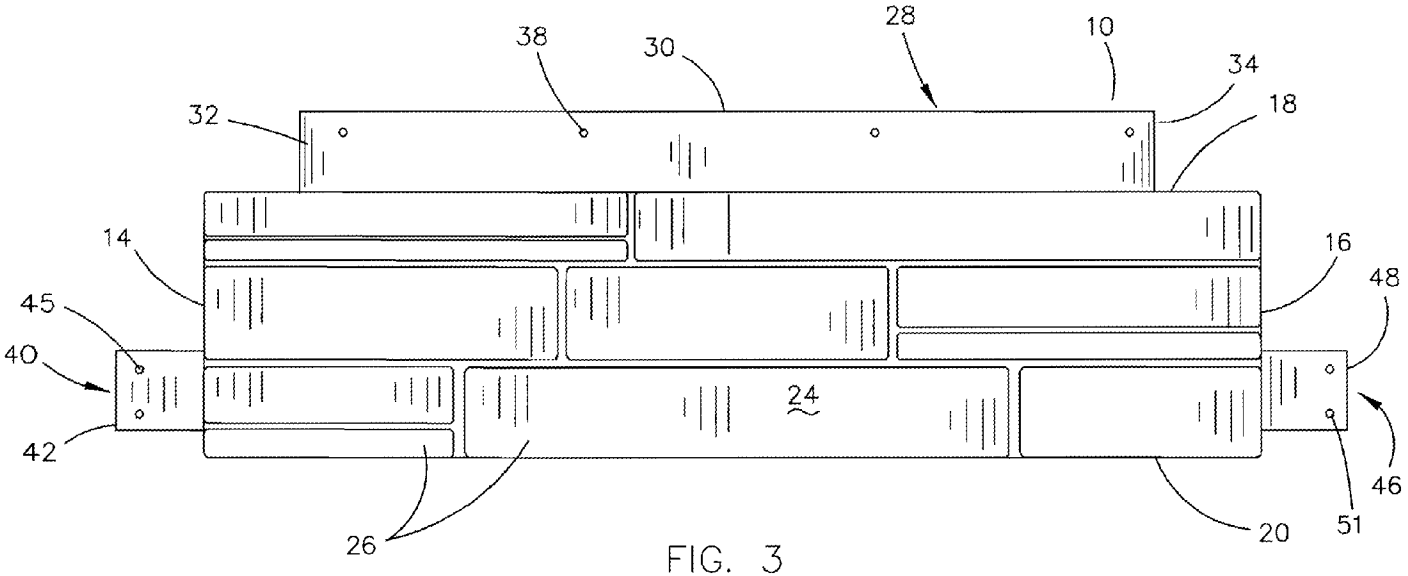
FIG. 3 is a front view of the invention.

The numeral 28 refers to an upper attachment flange which is preferably comprised of a metal material but which could be comprised of plastic if so desired. Flange 28 is generally rectangular in shape and which has an upper end 30, a first end 32, a second end 34, and a lower end 36 which is embedded in the inner side 22 of panel 10 adjacent the upper end of panel 10. As seen, flange 28 has a length which is less than the length of panel 10. Flange 28 may be provided with a plurality of nail or screw openings 38 formed therein below the upper end 30 of flange 28 as seen in FIGS. 1 and 3.

Figure 2:
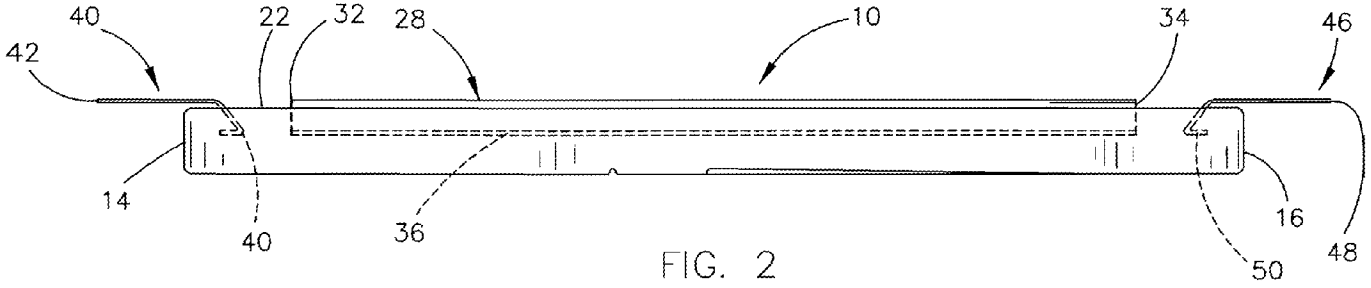
FIG. 2 is an upper elevational view of the invention.
Figure 4:
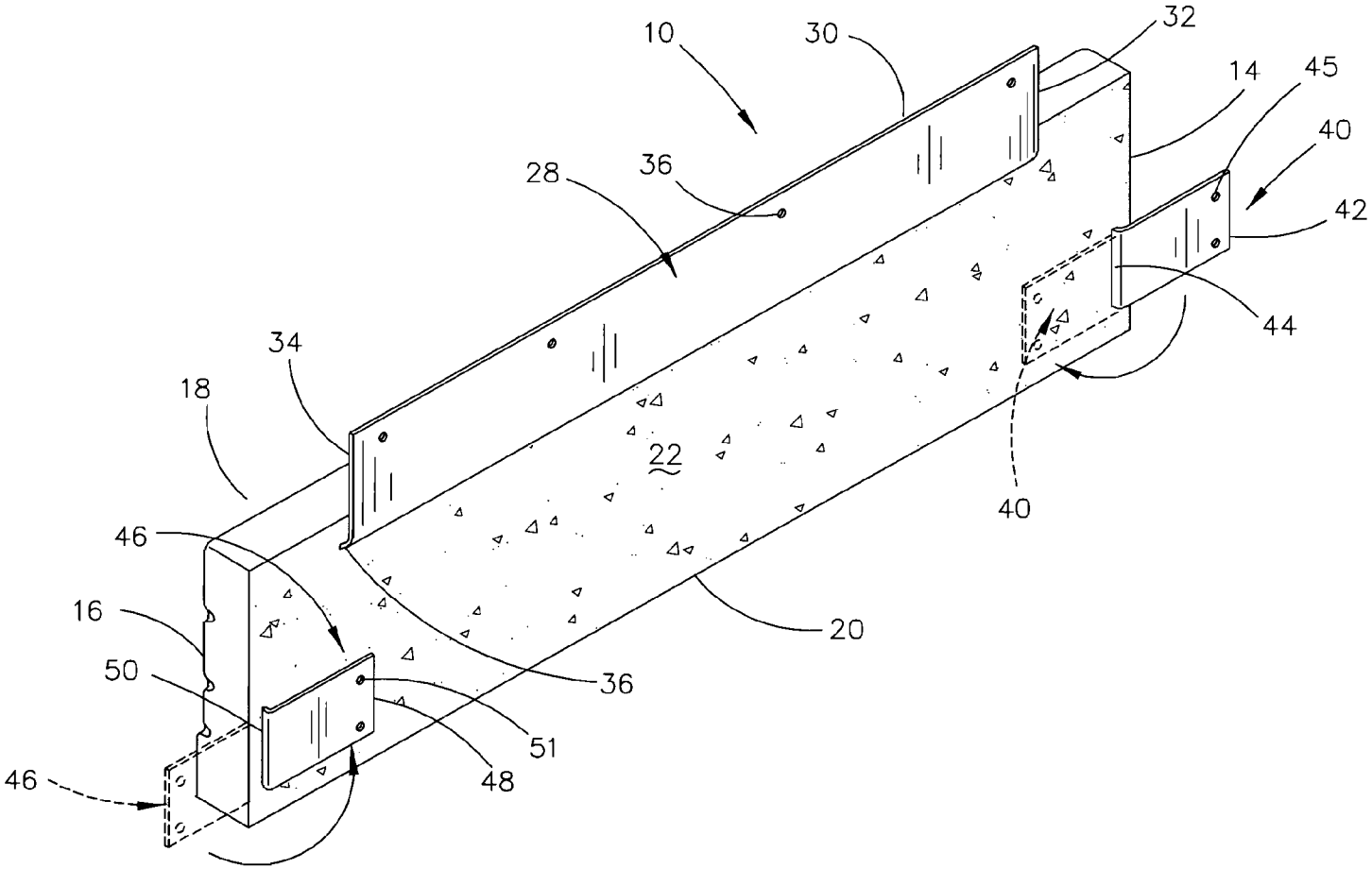
FIG. 4 is a rear perspective view of the invention which illustrates that the first and second end attachment flow may be moved between attachment and non-attachment positions.
Figure 5:
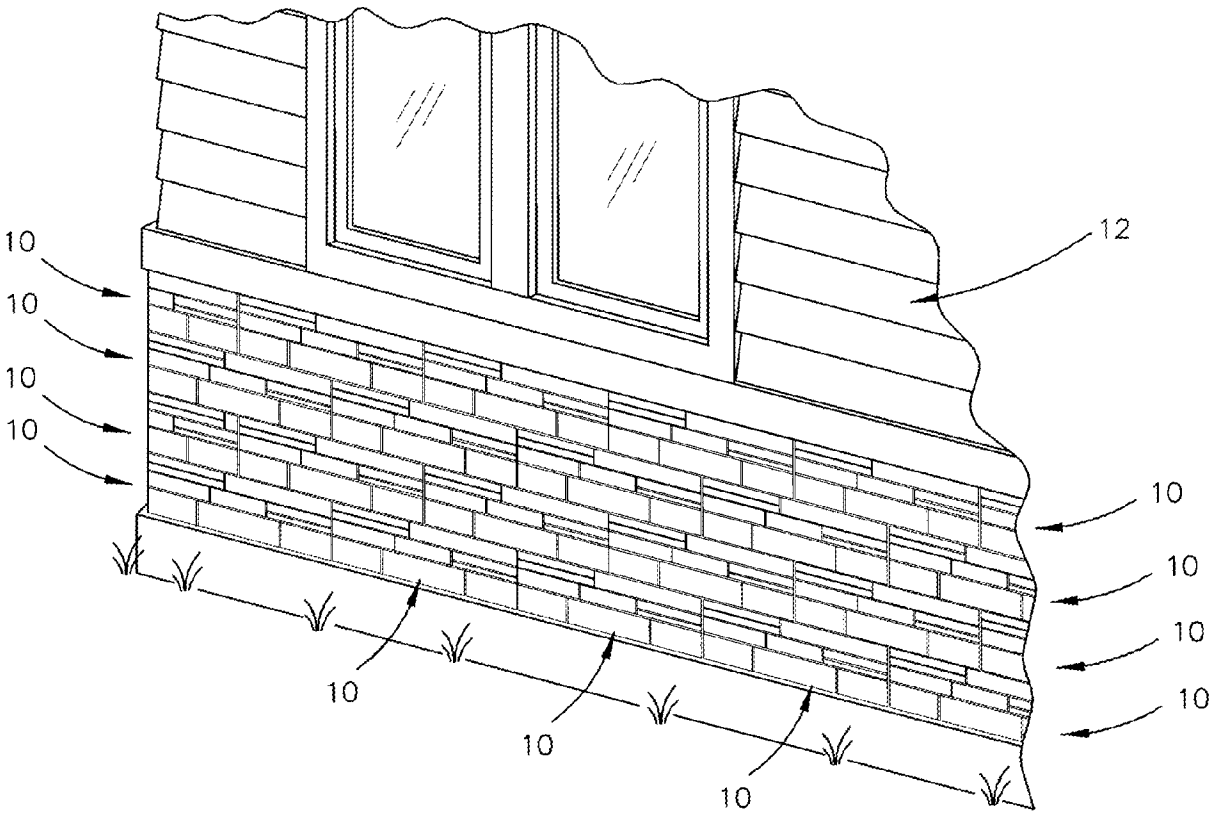
FIG. 5 is a partial perspective view illustrating a plurality of the panels of the invention mounted on the exterior of a building.

The numeral 40 refers to a first end attachment flange having an outer end 42 and an inner end 44 which is embedded in the inner side 24 of panel 10 inwardly of end 14 of panel 10. Flange 40 may be comprised of a metal material such as tin, steel, aluminum, etc. Flange 40 may be comprised of a plastic material as well. Flange 40 may have one or more nail or screw openings 45 formed therein. Flange 40 may be selectively bent from the outwardly extending attachment position of FIGS. 2 and 3 to the inwardly stowed or folded position as depicted in FIG. 4.

The numeral 46 refers to a second end attachment flange having an outer end 48 and an inner end 50 which is embedded in the inner side 24 of panel 10 inwardly of end 16 of panel 10. Flange 46 may be comprised of a metal material such as tin, steel, aluminum, etc. Flange 46 may be comprised of a plastic material as well. Flange 46 may have one or more nail or screw openings 50 formed therein. Flange 46 may be selectively bent from the outwardly extending attachment portion of FIGS. 2 and 3 to the folded position of FIG. 4. As seen, the flange 46 is shown in its outwardly extending attachment position in FIGS. 1, 2 and 3 and is shown in its folded non-attachment position in FIG. 4.

Assuming that the panels 10 are going to be secured to the exterior of the wall 12 beginning at the lower left side thereof, the panels 10 will be secured to the wall 12 as will now be described. The first end attachment flange 40 of one of the panels 10 will be folded inwardly from its solid line attachment position of FIG. 1 to the broken lines folded position of FIG. 4. The panel 10 will then be positioned on the wall 12 so that the left end 14 of the panel 10 will be flush with the end of the wall 12. The flange 28 will then be nailed or screwed to the wall by nails or screws. If the flange 28 has nail or screw openings, the nails or screws will be extended through those openings. If the flange 28 does not have nail or screw openings, the nails or screws will simply be driven inwardly through the flange 28. Nails or screws will be extended through the second end attachment flange into the wall 12 to provide additional attachment to the wall 12 in cooperation with the upper attachment flange 28.

The next panel which is to be secured to the wall to the right of the first panel 10 will have its first end attachment panel 40 folded inwardly to its folded non-attachment position at the rear side of the panel. The second panel 10 will be placed at the right end of the adjacent first panel 10. The upper attachment panel 28 and the second end attachment flange 46 of the second panel will be secured to the wall 12 by nails or screws. This procedure will be repeated until the panels 10 reach the desired location on the wall 12 to complete the first or lower course of the veneer.

A second course of panels will then be secured to the wall 12 as will now be described. Normally, the first or left panel 10 of the second course will begin with a panel 10 which is cut in half. The first half panel of the second course will have its second end attachment flange 48 in its attachment position. The half-panel 10 will be secured to the wall 12 by screws or nails extended through the flange 28 and the second end attachment flange 46. The next panel in the second course will have its first end attachment flange 40 folded. The upper attachment flange 28 and the second end attachment flange 46 are then attached to the wall. The second course will be completed with full length panels 10.

The third course will be comprised of full length panels 10. The fourth course will begin with a half-length panel and completed with full length panels. The procedure is repeated until the desired veneer has been provided.

The fact that some of the panels 10 will have one of their end attachment flanges positioned at the rear side thereof creates a small gap between the rear side of the panel 10 and the wall 12 to permit some air passage between the panels and the wall 12 to prevent moisture build-up on the wall 12.

Although the panel 10 is described as being rectangular in shape, the panel could be round, oval, diamond, square or flagstone shaped if so desired.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A mortarless stone veneer, comprising:

a concrete panel having an upper end, a lower end, a first end, a second end, a front side and a rear side;

a rectangular upper attachment flange having an upper end, a lower end, a first end, a second end, a front side and a rear side;

said lower end of said upper attachment flange being embedded in said rear side of said panel at said upper end thereof so as to extend upwardly from said upper end of said panel;

said upper attachment flange being configured to be secured to a vertically disposed support;

a first end attachment flange having an inner end, an outer end, an upper end, a lower end, an inner side and an outer side;

said inner end of said first end attachment flange being embedded in said rear side of said panel at said first end of said panel between said upper and lower ends of said panel;

said first end attachment flange being selectively bendable with respect to said panel between an attachment position and a non-attachment position;

said first end attachment flange extending outwardly from said first end of said panel when in said attachment position to enable said first end attachment flange to be secured to a vertically disposed support;

said first end attachment flange being positioned adjacent said rear side of said panel when in said non-attachment position;

a second end attachment flange having an inner end, an outer end, an upper end, a lower end, an inner side and an outer side;

said inner end of said second end attachment flange being embedded in said rear side of said panel at said second end of said panel between said upper and lower ends of said panel;

said second end attachment flange being selectively bendable with respect to said panel between an attachment position and a non-attachment position;

said second end attachment flange extending outwardly from said second end of said panel when in said attachment position to enable said second end attachment flange to be secured to a vertically disposed support; and said second end attachment flange being positioned adjacent said rear side of said panel at said second end of said panel when in said non-attachment position.

2. The mortarless stone veneer of claim 1 wherein each of said first and second end attachment flanges are generally flat.

3. The mortarless stone veneer of claim 1 wherein said attachment flanges have pre-drilled nail or screw openings formed therein.

4. The mortarless stone veneer of claim 1 wherein said first and second end attachment flanges are comprised of aluminum, steel, plastic or any other material which can withstand the elements.

5. The mortarless stone veneer of claim 1 wherein said panel is comprised of lightweight concrete.

6. The mortarless stone veneer of claim 1 wherein said end attachment flanges, when in their said non-attachment position, create an air gap between said rear side of said panel and the vertically disposed support.

7. The mortarless stone veneer of claim 1 wherein said front side of said panel has the appearance of bricks or stones.

8. The mortarless stone veneer of claim 1 wherein the vertically disposed support is a wall.

9. The mortarless stone veneer of claim 1 wherein said panel is comprised of regular weight concrete.

10. The mortarless stone veneer of claim 1 wherein said front side of the panel has the appearance of a brick.

11. The mortarless stone veneer of claim 1 wherein said front side of the panel has the appearance of a stone.

* * * * *